US010696068B2

(12) United States Patent
Weber et al.

(10) Patent No.: US 10,696,068 B2
(45) Date of Patent: Jun. 30, 2020

(54) ROTARY TABLE DIGITAL PRINTING MACHINE AND PRINTING UNIT

(71) Applicant: Hinterkopf GmbH, Eislingen/Fils (DE)

(72) Inventors: Joachim Weber, Bad Ditzenbach (DE); Joachim Schulz, Deggingen (DE); Michael Sonntag, Weiler ob der Fils (DE); Florian Goller, Sussen (DE)

(73) Assignee: HINTERKOPF GMBH, Eislingen/Fils (DE)

( * ) Notice: Subject to any disclaimer, the term of this patent is extended or adjusted under 35 U.S.C. 154(b) by 0 days.

(21) Appl. No.: 16/149,705

(22) Filed: Oct. 2, 2018

(65) Prior Publication Data

US 2019/0111709 A1 Apr. 18, 2019

(30) Foreign Application Priority Data

Oct. 17, 2017 (EP) ..... 17196877

(51) Int. Cl.

| | |
|---|---|
| ***B41J 3/54*** | (2006.01) |
| ***B41J 3/407*** | (2006.01) |
| ***B41J 2/165*** | (2006.01) |
| ***B41J 25/304*** | (2006.01) |
| *B41M 5/00* | (2006.01) |

(52) U.S. Cl.

CPC ..... *B41J 3/543* (2013.01); *B41J 2/165* (2013.01); *B41J 3/4073* (2013.01); *B41J 25/304* (2013.01); *B41M 5/0088* (2013.01)

(58) Field of Classification Search

CPC ..... B41J 3/4073; B41J 3/4075; B41J 3/543; B41J 11/002; B41J 2/17596

See application file for complete search history.

(56) References Cited

U.S. PATENT DOCUMENTS

| | | | | |
|---|---|---|---|---|
| 6,923,115 | B1 * | 8/2005 | Litscher | B41F 17/30 101/35 |
| 10,000,065 | B1 * | 6/2018 | Baker | B41J 2/17566 |
| 2005/0034423 | A1 * | 2/2005 | Sindermann | B65C 9/0062 53/136.1 |

(Continued)

FOREIGN PATENT DOCUMENTS

| | | |
|---|---|---|
| EP | 2860036 | 4/2015 |
| JP | 2016159583 | 9/2016 |

*Primary Examiner* — John Zimmermann

(74) *Attorney, Agent, or Firm* — Hoffmann & Baron, LLP

(57) ABSTRACT

Rotary table digital printing machine for printing on work pieces, including at least one workstation attached to a holding frame, which is designed as a printing unit for printing on work pieces and includes a support frame for receiving an inking unit and a print head module, the support frame including a printing unit interface for coupling with a printing unit receptacle associated with the holding frame and further including a print head interface designed for coupling with a print head module, with a print head module and with an inking unit adapted to provide a printing ink to the print head module, a print head carrier having a carrier interface adapted to be coupled to the print head interface, wherein the printing unit receptacle, the printing unit interface, the inking unit, the print head interface, the carrier interface and the print head module form a row arrangement arranged along the printing direction.

18 Claims, 3 Drawing Sheets

(56) References Cited

U.S. PATENT DOCUMENTS

| | | | | |
|---|---|---|---|---|
| 2007/0157559 | A1* | 7/2007 | Till | B41J 2/06 53/411 |
| 2010/0053279 | A1* | 3/2010 | Tamaki | B41J 2/175 347/85 |
| 2012/0199021 | A1* | 8/2012 | Till | B41J 3/4073 101/36 |
| 2015/0017272 | A1* | 1/2015 | Donaldson | B41J 3/4073 425/171 |
| 2015/0033965 | A1* | 2/2015 | Knott | B41F 17/00 101/36 |
| 2017/0334595 | A1* | 11/2017 | Saccardi | B41J 3/4075 |

* cited by examiner

ROTARY TABLE DIGITAL PRINTING MACHINE AND PRINTING UNIT

BACKGROUND OF THE INVENTION

The invention relates to a rotary table digital printing machine for printing on work pieces in an inkjet digital printing process. Furthermore, the invention relates to a printing unit for use in such a rotary table digital printing machine.

EP 2 860 036 A1 discloses a printing device for printing on a peripheral surface of a work piece, having at least two printing heads, each having at least one row arrangement of ink metering elements, in particular ink nozzles, which are each designed for an individual predefinable discharge of ink onto the work piece, wherein at least one of the print heads is arranged to be movable along an extension axis of the ink metering elements on a print head carrier and wherein the movably mounted print head is assigned an electrically controllable positioning unit for setting a position relative to the at least one further print head.

SUMMARY OF THE INVENTION

The object of the invention is to provide a rotary table digital printing machine and a printing unit, which ensure an improved reproducibility of a printing result.

This object is achieved for a rotary table digital printing machine of the type mentioned above with a rotary table digital printing machine which comprises a machine frame on which a work piece rotary table is rotatably mounted about an rotation axis, the work piece rotary table is provided with a plurality of work piece carriers, which are all arranged with the same angular pitch and the same distance from the rotation axis, wherein a drive unit is assigned to the work piece rotary table for providing a rotary step movement, wherein said machine frame comprises at least one holding frame, which is adapted to receive workstations, which workstations are adapted for processing work pieces, and wherein at least one workstation is attached to the holding frame and is designed as a printing unit for printing on work pieces, wherein the printing unit comprises a support frame, which is designed to receive an inking unit and a print head module and which has a printing unit interface, which is designed for coupling with a printing unit receptacle associated with the holding frame, wherein the support frame comprises a print head interface which is adapted for coupling to a print head module, further comprising a print head module which is adapted for dispensing ink droplets in a printing direction onto a work piece and which comprises a print head carrier and at least one print head fixed to the print head carrier, and further comprising an inking unit which is configured to provide ink to the print head module, the print head carrier comprising a carrier interface adapted for coupling to the print head interface, wherein the printing unit receptacle, the printing unit interface, the inking unit, the print head interface, the carrier interface, and the print head module are arranged in a row arrangement extending along the printing direction.

The work pieces may be sleeve-shaped bodies made of metal or plastic, which serve, for example, as blanks for the production of aerosol cans or plastic tubes.

By way of example, the holding frame is designed as an annular plate and arranged above the work piece rotary table, wherein a central axis of the holding frame is preferably aligned parallel to the rotation axis. The holding frame is designed as an integral part of the machine frame and is used to hold workstations, wherein at least one workstation is designed as a printing unit for printing on work pieces. Further workstations can be designed to prepare the work pieces received on the work piece carriers and conveyed from one workstation to the next in the course of a rotary step movement for carrying out the printing operation provided with the at least one printing unit or to carry out further working steps on the work piece after the printing operation has been carried out. By way of example it is provided that a plurality of printing units are mounted on the holding frame, which are formed, for example, for printing different colors onto the work piece.

The printing unit comprises a support frame, on which a printing unit interface is formed, which is designed for a fixation of the printing unit to a printing unit receptacle, wherein the printing unit receptacle is coupled to the holding frame. Preferably, the support frame comprises two spaced-apart frame parts, which form a U-shaped profile together with the print head interface, wherein the frame parts form the lateral U-legs. It can be provided that the inking unit is arranged adjacent to the printing unit interface between the two frame parts, while the print head module is arranged on a side facing away from the printing unit interface of the inking unit.

For a reproducible fixation of the print head module on the support frame, the print head carrier comprises a carrier interface which is adapted to a print head interface of the support frame in such way that when disassembling the print head module from the support frame, as may be required for maintenance purposes, and a subsequent mounting of the same or another print head module to the support frame little or no adjustments for the alignment of the print head module relative to the work piece carriers and the work pieces received on the work piece carriers are necessary.

In order to achieve the desired improvement in the reproducibility of the printing result that can be achieved with the rotary table digital printing machine, it is advantageous if the printing unit receptacle, the printing unit interface, the inking unit, the print head interface, the carrier interface and the print head module form a series arrangement which is lined up in the printing direction. Due to the alignment of the components a compact arrangement of the components is realized, so that dimensional deviations and tolerances of the components which are mechanically coupled to one another have a smaller influence than in the case of a spatially projecting arrangement of the components. Furthermore, the series arrangement of the mechanical interfaces of the components also ensures an at least largely symmetrical transmission of forces between the components, which likewise enables a precise alignment of the at least one print head relative to the holding frame and the work piece carriers.

Advantageous developments of the invention are specified in the dependent claims.

It is expedient for the carrier interface and the print head interface to comprise two pairs of centering elements, which are designed for reproducible positioning of the print head carrier on the support frame. By way of example, a pair of centering elements comprises a high-precision plug connection, which is formed, in particular, by a dowel pin and a corresponding recess designed as a fit, wherein the dowel pin is assigned to one of the interfaces and the recess is assigned to the respective other interface. Since two pairs of centering elements are provided, it is also necessary that the centering elements associated with the respective interface are arranged with high precision to each other and the arrangement exactly matches the arrangement of the centering on the other interface, since only in this case a coupling of the two pairs of centering elements is possible, If these boundary conditions are met, it may be assumed that after a disassembly of the print head carrier from the support frame and a subsequent assembly of the print head carrier to the support frame, the print head module is in the same position relative to the holding frame and the work piece carriers.

It is preferably provided that the at least one print head is arranged in a predeterminable arrangement with respect to the at least two centering elements formed on the print head carrier. This ensures that when replacing a first print head module against a second print head module, the at least one print head arranged on the second print head module occupies exactly the same position relative to the holding frame and the work piece carriers as the at least one print head of the first print head module. By way of example, it is provided that the centering elements are used as a reference for mounting the respective print head to the print head carrier and that the respective print head can be displaced until a final position on the print head carrier until it assumes a predetermined position relative to the centering elements.

In an advantageous embodiment of the invention, it is provided that the carrier interface and/or the print head interface comprise a planar surface oriented normal to the printing direction, wherein at least two centering elements are arranged on the planar surface. Here, the planar surface serves in addition to the centering effect by the centering elements for aligning the print head carrier relative to the support frame and thus supports the precise mounting of the print head module on the support frame.

In a further embodiment of the invention, it is provided that the print head interface is movably mounted on the support frame with at least one, in particular with exactly one, degree of freedom of movement and in that an adjusting component for an provision of a, in particular linear, adjusting movement between the support frame and support interface is provided. As a result, a relative movement of the print head interface with the print head module fixed thereto relative to the support frame is made possible, for example, to allow adjustment of a spatial position of the at least one print head with respect to the work piece carriers. It is preferably provided that the adjusting component is designed to provide a linear movement, wherein a movement axis of this linear movement is oriented in the radial direction and thus extends transversely to the rotation axis of the work piece rotary table. With an adjusting component designed in this way, a linear displacement of the print head module can be provided before the execution of a printing operation. This is of particular interest when the work piece carriers are oriented such that center axes of the work pieces are oriented transversely to the rotation axis of the work piece rotary table and when the work pieces rotate about their central axis during the printing process. In this case, due to the superposition of the linear movement of the print head module and the rotational movement of the work piece, a spiral print image is formed on the outer surface of the work piece.

It is advantageous if the inking unit comprises a control unit, a color pipe for an ink supply and a discharge pipe for an ink delivery to the print head module, wherein the color pipe and the discharge pipe are connected to a valve unit which is designed to influence an printing ink volume flow in the discharge pipe, and wherein the control unit is designed to control the valve unit and/or the at least one print head. The main task of the inking unit is thus to provide the ink conveyed via the color line in a suitable amount to the print head module. For this purpose, the inking unit comprises the valve unit, which is preferably designed as a proportional valve and provides in response to a control signal of the control unit the desired printing ink volume flow to the print head module. Additionally or alternatively, the control unit may be provided for a control of the print head, which is in particular an ink jet print head based on piezo technology.

It is expedient if the print head module comprises at least two print heads, each print head having a plurality of printing nozzles which are arranged along a radial direction with constant pitch and forming a row of nozzles, the nozzle rows of the respective print heads are arranged parallel to each other and wherein at least one of the print heads comprises a positioning component which is designed for a linear displacement of the respective print head in the radial direction relative to the print head carrier, wherein the control unit is designed for a control of the print heads and the positioning component. With the linear adjustment of the at least one print head, an adaptation of the print head module to different work piece diameters can be achieved. In order to achieve a given density of printing dots on the surface of the work piece, which are provided by the respective printing nozzles of the print heads, a pitch adjustment for a pitch of the spiral print image depending on the work piece diameter is required, which can be realized by means of the positioning component. The control unit serves on the one hand for controlling the positioning component, which may be in particular a piezoelectric actuator, and on the other for controlling the print heads, wherein depending on the relative position of the print heads to each other possibly individual nozzles of the print heads for the respective printing operation can be temporarily disabled to prevent unwanted overlapping of printing dots in the print image.

In a further embodiment of the invention, it is provided that at least one positioning unit for influencing a spatial orientation of the printing unit interface with respect to the holding frame is arranged between a printing unit receptacle attached on the holding frame and the holding frame. By way of example, the positioning unit can influence a parallelism between the nozzle rows of the print heads and the center axes of the work pieces or the work piece carriers, which are designed as spindles. Additionally or alternatively, the positioning unit can be used to adjust a radial position of the print heads, i.e. a distance to the rotation axis. Additionally or alternatively the positioning unit allows an adjustment of an axial offset between the nozzle rows of the print heads and the central axes of the work pieces. In addition, the adjusting component can additionally or alternatively also be designed for an angle adjustment between the nozzle rows of the print heads and the center axes of the work pieces.

It is preferably provided that a color processing module arranged adjacent to the printing unit interface is arranged on an end region of the row arrangement which end region is opposite the print head module and that the color processing module is connected to a color pipe which is designed for supplying ink to the inking unit. The task of the color processing module is to prepare the ink delivered from a color reservoir for use in the printing unit. Due to the arrangement of the color processing module at an end region of the row arrangement, which end region is opposite to the print head module, an advantageous conveying path for the ink can be achieved since the ink is conveyed starting from the color processing module to the color module arranged adjacent to the color processing module in the row arrangement and from there further along the row arrangement to the print head module to be fed there to the print heads.

In an advantageous embodiment of the invention, it is provided that the color processing module comprises a pump unit for conveying printing ink and/or a printing ink reservoir for temporary storage of printing ink and/or a temperature control unit for a temperature control of the printing ink and/or a degassing unit for degassing the printing ink and/or a filter unit for filtering the ink. Preferably, the color processing module comprises at least one temperature control unit for the temperature control of the ink, a degassing unit, which is designed for the separation of gas bubbles from the ink, and a filter unit for filtering the ink before further transport to the inking unit to remove any remaining particles that could clog the print nozzles. In addition, a pump unit and/or a printing ink reservoir can be provided, wherein the pump unit is designed to convey the printing ink from a color reservoir and the ink reservoir is designed for buffering and calming the printing ink before it is fed to the temperature control unit and the degassing unit and the filtering unit.

It is advantageous if, opposite to the print head module, a drying module is arranged in the row arrangement and is arranged on the machine frame, which delimits a work piece gap with the print head module in the printing direction and which is designed to provide drying energy to a work piece arranged in the work piece gap. By way of example, the drying module is designed for the provision of thermal energy or energy in the form of electromagnetic radiation, in particular ultraviolet radiation, in order to ensure a rapid and efficient curing of the printing ink on the surface of the work piece. Due to the arrangement of the drying module in the series arrangement, a small space requirement for the combination of printing unit and drying module is ensured in a circumferential direction, so that several printing units and associated drying modules may be arranged on the machine frame in small angular pitch next to each other on the holding frame.

It is preferably provided that the work piece carriers determine a work piece plane oriented normal to the rotation axis of the work piece rotary table and that the printing unit interface, the inking unit, the print head interface, the carrier interface and the print head module are arranged in the vertical direction above the work piece plane. As a result, this arrangement ensures the desired compact arrangement of the printing unit at the rotary table digital printing machine because in the area above the work piece plane no consideration must be taken to spatial requirements, which are determined for example by the work piece rotary table and the drive unit for the work piece rotary table.

It is expedient if at least one color reservoir and a cleaning module, in particular combined with a drying module, are arranged in a section arranged in the vertical direction below the work piece plane.

In a further embodiment of the invention it is provided that the printing direction is aligned parallel to the, in particular perpendicularly oriented, rotation axis.

The object of the invention is also achieved by a printing unit for use in a rotary table digital printing machine. For this purpose, the printing unit comprises a support frame, which is designed to receive an inking unit and a print head module and which has a printing unit interface, which is designed for coupling to a printing unit receptacle of a rotary table digital printing machine. The support frame having a print head interface, for coupling with a print head module and a print head module adapted for dispensing ink droplets in a printing direction onto a print object and comprising a print head carrier and at least one print head fixed to the print head carrier, and an inking unit configured to provide a printing ink to the print head module, the inking unit comprising a color pipe for an ink supply and a discharge pipe for an ink discharge, wherein the color pipe and the discharge pipe are connected to a valve unit which is designed for influencing an ink volume flow in the discharge pipe, wherein the print head carrier comprises a carrier interface, which is designed for coupling with the print head interface, wherein the printing unit interface, the inking unit, the print head interface, the carrier interface and the print head module are arranged in series along the printing direction.

BRIEF DESCRIPTION OF THE DRAWINGS

An advantageous embodiment of the invention is shown in the drawing. Hereby shows.

Advantageous embodiments of the invention are illustrated in the drawing. Hereby shows.

DETAILED DESCRIPTION

Figure 1:
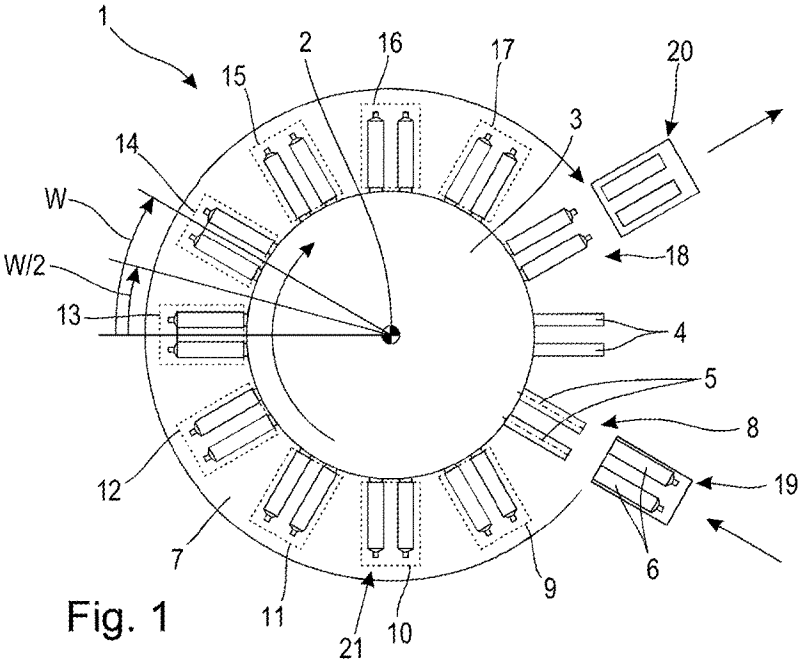
FIG. 1 is a schematic plan view of a rotary table digital printing machine with a work piece rotary table which is rotatably mounted and which comprises several workstations for printing and inspection of cylindrical work pieces.

A rotary table digital printing machine 1 shown purely schematically in FIG. 1 comprises a work piece rotary table 3 rotatably mounted about a rotation axis 2 on a machine frame, not shown in detail, and several work piece carriers 4, which are mounted in pairs on the work piece rotary table 3. The work piece carriers 4 are rotatably mounted with rotation axes 5 and are individually with respective drive units. The work piece carriers 4 are provided for receiving sleeve-shaped, at least substantially cylindrical work pieces 6, which are in particular designed as aerosol can blanks or tube blanks. Preferably, the work piece carriers 4 are formed as mandrels on which the work pieces 6 designed as hollow bodies, in particular hollow cylinders closed on one side, can be plugged.

In an annular region 7 which is swept by the work piece carrier 4 during a rotational movement of the work piece rotary table 3 about the rotation axis 2 and which extends in the radial direction around the work piece rotary table 3, a plurality of work stations 8 to 18 are arranged, which are designed for a processing and/or testing of the work pieces 6 transported with the work piece rotary table 3. Since the view according to FIG. 1 is a plan view and the workstations 9 to 17 are arranged at least partially in the vertical direction above the work piece carriers 4, the workstations 9 to 17 are only shown in dashed lines in FIG.

The work station 8 is a loading station on which the cylindrical work pieces 6 are pushed, exemplarily in pairs, onto the work piece carrier 4 by a suitable transport device 19, which is coupled to a conveyor system for the cylindrical work pieces 6.

By way of example, a rotational position of the cylindrical work pieces 6 is determined at the workstation 9 by a first optical scanning of the cylindrical work pieces 6, for example to ensure a correct rotational alignment of the cylindrical work pieces 6 for a printing operation taking place at the workstation 10. This is particularly important if the surface to be printed on the work pieces 6 is provided with features that have to be aligned in a predetermined manner with the print image. Such features may be, for example, local embossing of the surface of the work piece 6 and/or pre-printed areas, wherein the pre-printed areas may serve as a base layer for subsequent printing. Preferably it can be provided to print on a partially formed or already completely formed work piece 6, which in particular has indentations and/or shapes, so that the printed image is aligned with the deformed areas. Therefore it is not necessary to carry out a deformation of the work piece on the basis of a pre-applied printed image. It is preferably provided to print a shaped aerosol can blank with indentations and/or embossings which are placed locally or over its entire peripheral surface, wherein the aerosol is provided after the printing in the printed areas with a protective coating, in particular a transparent varnish, and is then ready for a filling, The work station 10 comprises by way of example a printing unit 21 shown in greater detail in FIGS. 2 and 3, with which the cylindrical work pieces 6, which are rotated about respective axes of rotation 5, are printed using print heads 22, 23 and 24, as shown in more detail in FIG. in a given area.

The workstation 14 is embodied as an inspection device by way of example and allows to determine a print quality of the printed image applied by the printing unit 21 to the peripheral surface of the work piece 6.

The other workstations 11 to 13 and 15 to 17 are used for further processing of the cylindrical work pieces 6, for example for applying a protective lacquer to the printing or for mounting components to the work pieces 6.

At the workstation 18, an unloading process takes place in which the cylindrical work pieces 6 are withdrawn by means of a transport device 20 from the mandrel-like work piece carriers 4 and fed to a further transport system.

Figure 1A:
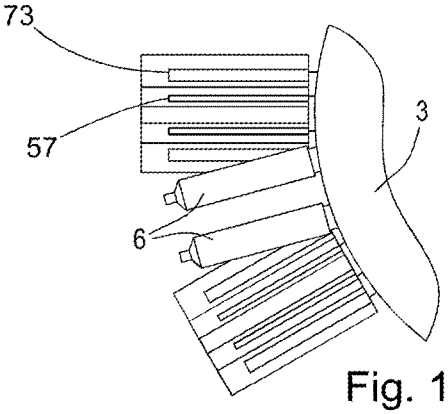
FIG. 1*a* shows an enlargement of the rotary table digital printing machine according to FIG. 1 in an intermediate position for the work piece rotary table.

The work piece rotary table 4 performs the stepwise processing of the cylindrical work pieces 6 at the respective workstations 8 to 18 with a rotational step movement by the angle W, in which the paired work piece carriers 4 are transported from a position opposite to one of the respective workstations 8 to 18 to a position opposite to a respective subsequent workstation 8 to 18. In this case, the rotational step movement takes place as a sequence of an acceleration from standstill to a target speed and a deceleration from the achieved target speed to a standstill and a subsequent downtime. Preferably, a non-illustrated drive for the work piece rotary table 3 is designed such that the acceleration and deceleration of the work piece rotary table 3 and the downtime are completely adjustable in a wide range and may be adapted to the requirements of processing the respective cylindrical work pieces 6 at the workstations 8 to 18. Furthermore, the drive of the work piece rotary table 3 can be controlled such that the work piece carrier 4 may execute an intermediate step, which can be used for cleaning or other maintenance of workstations 8 to 18 with a rotary step movement with the step size W/2 between the workstations 8 to 18 as shown schematically in FIG. 1*a*. This is important, for example, for carrying out a cleaning of the print heads 22, 23, 24.

The printing unit 21 comprises by way of example two groups of print heads 22, 23, 24, each having a strip-like shape and on whose end face 25, 26 facing the cylindrical work piece 6 comprises a nozzle row which is oriented exemplarily along a central axis 27. Each of the rows of nozzles comprises a plurality of ink metering elements which are arranged in the same pitch or spacing to their respective neighbours and which are exemplarily designed as nozzles. For example each of the ink metering elements can be electrically controlled individually and, in the illustrated embodiment, can be designed to dispense defined ink drops.

Figure 2:
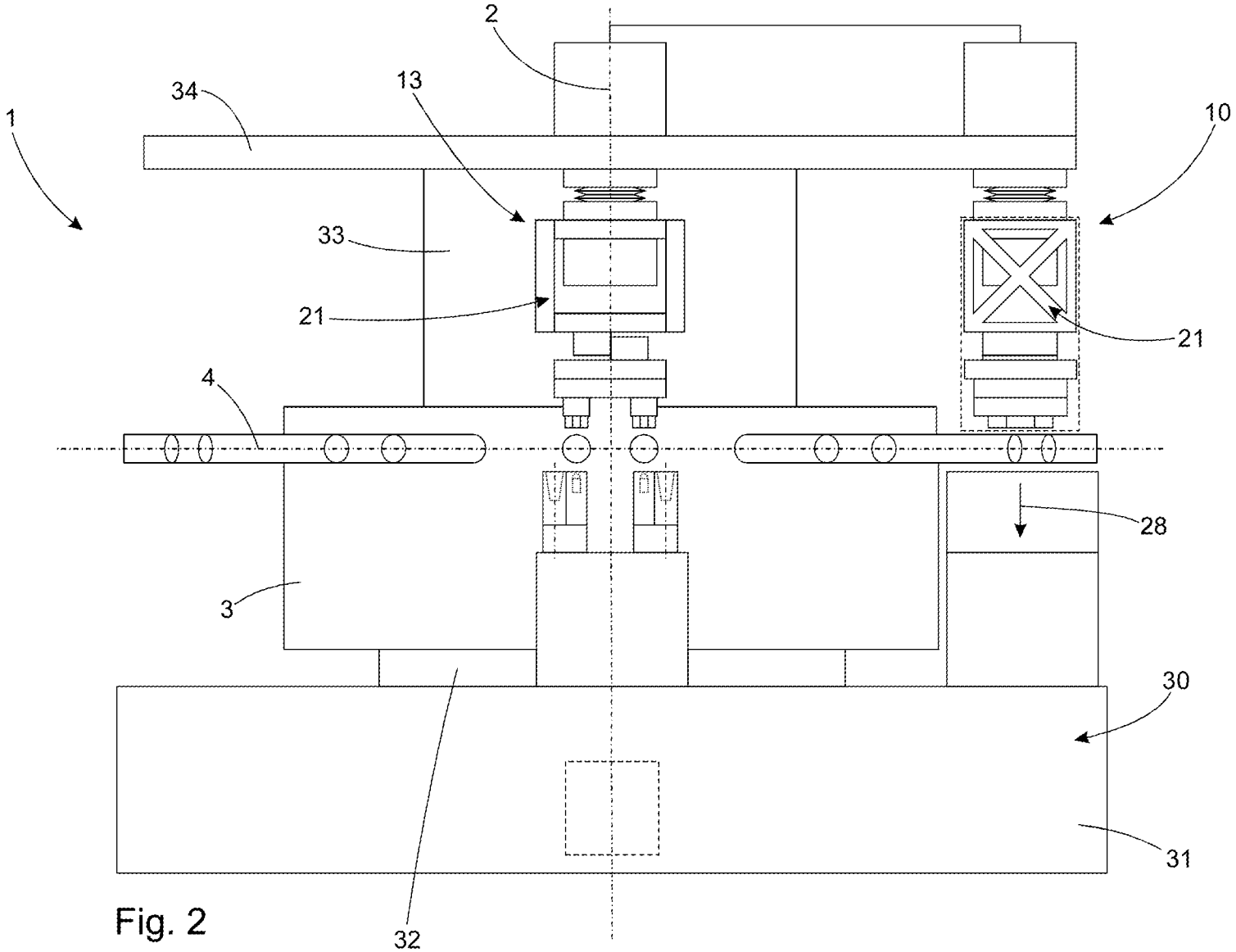
FIG. 2 is a schematic front view of the rotary table digital printing machine.

As can be seen from the purely schematic front view of FIG. 2, the machine frame 30 comprises a machine bed 31 for laying on the ground, on which a stator 32 of a rotary direct drive, for example a Torque-Motor, is arranged for providing rotational movement for the work piece rotary table 3. Accordingly, the work piece rotary table 3 forms the rotor of the rotary direct drive.

In order to allow an advantageous attachment of workstations 8 to 18 on the rotary table digital printing machine 1 a support tube 33 extends from the stator 32 purely exemplarily coaxial with the rotation axis 2 in a vertical upward direction, which passes through a recess of the ring-shaped work piece rotary table 3, At an upper end portion of the support tube 33, an exemplary circular disk-shaped support plate 34 is arranged, which is used for fixing the work stations 8 to 18 above the respective work piece carrier 4. For clarity reasons only two printing units 21 are arranged on the support plate 34, wherein one of the printing units 21 is shown—due to its arrangement on the support plate 34 in the front view—while the other of the printing units 21 shown—due to its arrangement on the support plate 34—in the side view. Each of the printing units 21 is designed to provide ink droplets in a printing direction 28, so that the ink droplets impinge transversely on the surface of the respective work piece 6 at least almost in a vertical direction.

The explanations below relate in each case to both of the printing units 21 shown in FIG. 2, which are designed to be technically identical, so that a distinction with regard to designations or reference numbers is unnecessary.

The printing unit 21 comprises, purely by way of example, two laterally arranged frame parts 35, 36 which, together with a plate-shaped printing unit interface 37, form the support frame 38 of the printing unit 21 and determine a U-shaped profiling. The printing unit interface 37 is connected at an upper side 39 to a printing unit receptacle 40 described in more detail below.

In an intermediate space between the frame parts 35, 36, an inking unit 43 is arranged, which will be described below in connection with the FIG. 3 in more detail.

At a lower end portion of the frame parts 35, 36, a print head interface 44 is arranged, which comprises a connecting plate 45, an electric spindle drive linear drive 46 and a connecting plate 47 fixed to a movable carriage of the linear drive 46. With the linear drive 46, a linear adjustment of the connecting plate 47 transversely to the rotation axis 2 and therefore in the radial direction relative to the work piece rotary table 3 can be performed.

Figure 4:
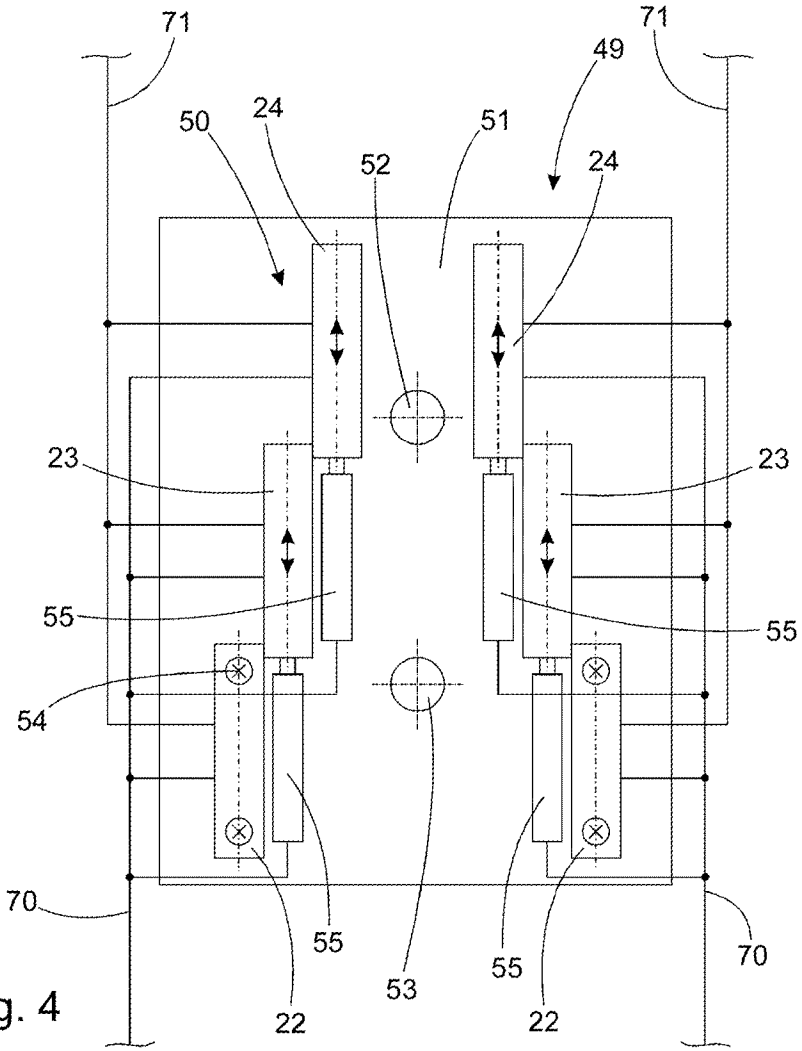
FIG. 4 is a schematic representation of a plan view of a print head carrier equipped with a plurality of print heads.

A print head module 49, which, as shown in FIG. 4, essentially comprises a plate-shaped print head carrier 50 and the print heads 22, 23 and 24 fixed to the print head carrier 50, is mounted on an underside 48 of the connecting plate 47, which purely by way of example a planar surface.

By way of example, it is provided that the print head carrier 50 is formed planar on an upper side 51 facing the connecting plate 47, so that the upper side 51 can be brought into planar contact with the lower side 48 and hereby forms a carrier interface. In order to ensure an exact and reproducible spatial alignment between the print head carrier 50 and the connecting plate 47, two precisely positioned centering pins 52, 53 are mounted on the upper side 51, which protrude in the direction of the connecting plate 47 over the upper side 51 and can engage in fitting bores in the connecting plate 47, which are likewise positioned exactly one to another, and thus the centering pins 52, 53 can be regarded as components of the carrier interface.

In order to ensure exact alignment of the print heads 22, 23 and 24 relative to the centering pins 52, 53 serving as centering elements, it is provided that the print head 22, which is screwed firmly to the print head carrier 50 and the print heads 23, 24, each of which can be moved linearly displaceably on the print head carrier 50, are aligned using a high-precision measuring device such as a measuring table and to fix the respective, only symbolically shown fastening screws 54 after successful alignment. For the linearly movable arrangement of the print heads 23, 24, each of the print heads 24 is assigned an electrical linear actuator 55.

Figure 3:
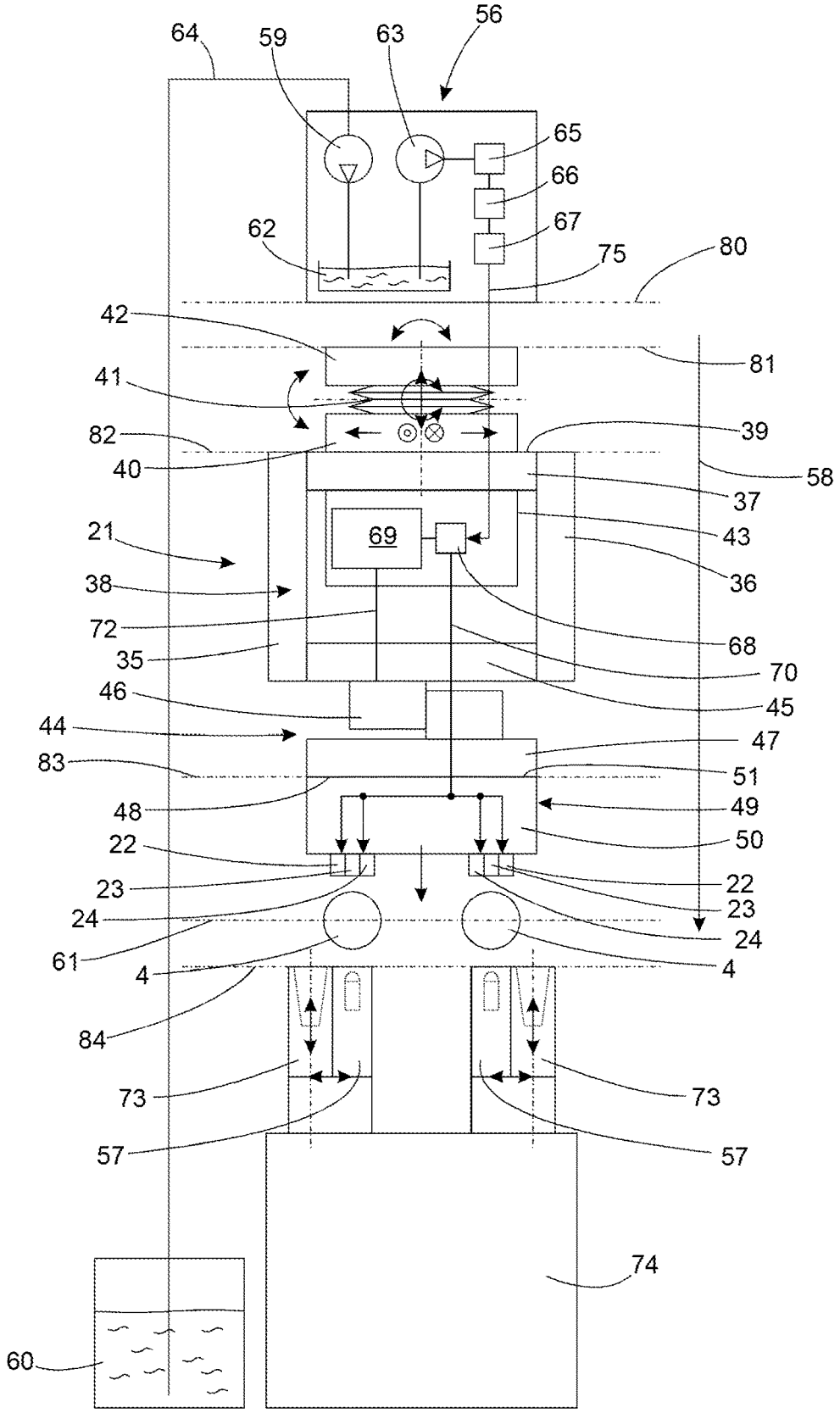
FIG. 3 is a schematic front view of a printing unit for use in the rotary table digital printing machine.

In the illustration of FIG. 3, the series arrangement for the above-described components of the printing unit 21 and for the peripheral components likewise necessary for carrying out the printing operation, such as a color processing module 56 and a drying module 57, are clearly visible.

In order to achieve a compact and maintenance-friendly arrangement of the components of the printing unit 21 and the peripheral components, these are lined up in the series arrangement along an extension axis 58 aligned in particular parallel to the printing direction 28, which represents the sequence of the components downwards in a purely exemplary manner.

Thus, in particular, the print head module 49 and the print heads 22, 23, 24 mounted on the print head carrier 50 can be easily accessed.

With the centering elements, purely exemplarily designed as centering pins 52, 53 and the mutually corresponding surfaces a simple replacement of the print head carrier 50 is ensured, the position of the print head carrier 50 is precisely reproducible. Furthermore, the print head carrier 50 with the attached print heads 22, 23 and 24 has only a relatively small volume, so that a shipment of replacement and replacement parts by postal mail is possible and thus encountered problems at the print heads 22, 23 and 24 can be solved in a short time in a worldwide manner.

In the illustration of FIG. 3, the settings for the printing unit holder 40 relative to the support plate 34 are represented. By way of example, it is provided that the printing unit receptacle 40 is coupled via adjusting means surrounded by an elastic bellows 41 with a holding plate 42, which in turn is connected to the support plate 34 serving as a holding frame. The adjusting means arranged between the printing unit receptacle 40 and the holding plate 42 make it possible to adjust the relative spatial position of the printing unit receptacle 40 relative to the holding plate 42, these adjusting means being in particular formed from the group: manually adjustable adjusting spindle, electric linear drive, electric rotary drive to allow precise alignment of the printing unit holder 40 and the printing unit 21 accommodated thereon in relation to the work piece carriers 4. By way of example, the adjusting means allow a linear displacement in three mutually perpendicular spatial directions, as indicated by the arrows oriented in the vertical and horizontal directions and the symbolic arrow ends and arrow heads. Furthermore, it is provided by way of example that the adjusting means allow pivoting movements about three axes oriented perpendicular to one another, as symbolized by the curved double arrows.

From the schematic representation of FIG. 3, it can be seen that the mechanical interfaces of the components of the printing unit 21 and the peripheral components determine, purely by way of example, several interface planes 80 to 84 arranged parallel to one another and arranged along the row arrangement, which are intended to be parallel to the work piece plane 61 defined by the work piece carriers 4. The color processing module 56 determines with its underside the interface plane 80, which is uppermost in the vertical direction an which is synonymous with an upper side of the support plate 34, not shown in FIG. 3. The interface plane 81, which is equivalent to an underside of the support plate 34, not shown in FIG. 3, serves for fixing of the holding plate 42 of the printing unit holder 40. The interface plane 82 denotes the plane between the printing unit holder 40 and the printing unit 21.

The interface plane 83 is determined by the connection between the print head interface 44 and the print head module 49. Below the work piece plane 61, the upper side of the drying module 57 forms a further interface plane 84, which, however, deviating from the other interface levels 80 to 83 does not describe any mechanical connection to other components, but only an exit plane for the electromagnetic waves, in particular UV rays, provided by the drying module 57, As can also be seen from the representation of FIG. 3, the ink processing module 56 comprises a pump 59, which is designed to convey ink from a color reservoir 60, which is purely exemplary arranged in the vertical direction below the work piece plane 61, which is defined by the work piece carriers 4 and which is oriented normal to the rotation axis 2. The printing ink as pumped by the pump 59 is first stored in a calming tank 62 and pumped from there with a further pump 63 in a color pipe 75. By way of example, a series circuit of a degassing unit 65, a filter unit 66 and a temperature control unit 67 is provided in the color pipe 75, with which the printing ink for use in the printing unit 21 is conditioned.

The color pipe 75 is connected to a valve unit 68 arranged in the inking unit 43, which is formed for example as a proportional valve and which is electrically coupled to a control unit 69 integrated in the inking unit 43. The control unit 69 is configured such that the valve unit 68 is actuated in such a way that correct ink supply is always effected to the print head module 49 via a supply pipe 70 which also branches off in the print head module 49 for a supply of each of the print heads 22, 23 and 24 with printing ink. The supply pipe 70 is shown in detail in FIG. 4; it can also be seen from FIG. 4 that the print heads 22, 23 and 24 are each connected to the control unit 69 via a common control line 71, without this being shown in the illustration of FIG. 3 is shown in more detail.

The control unit 69 is further provided for driving the linear drive 46, wherein the linear movement as provided by the linear drive 46, which is aligned in the radial direction, may by superposed with a rotational movement of the work piece carrier 4 and the work pieces 6 received thereon to provide spiral printing paths on the work pieces 6 for the ink droplets discharged from the print heads 22, 23 and 24. For this purpose, a control line 72 is formed between the control unit 69 and the linear drive 46, with which also a control of the linear actuator 55 for a relative movement of the print heads 23, 24 relative to the print head 22 is executed.

Below the work piece plane 61, a drying module 57 is arranged for each of the work piece carriers 4, which is combined purely by way of example with a cleaning module 73, wherein the drying module 57 and the cleaning module 73 are arranged linearly movable on the machine bed 31 with the aid of an actuator 74 and also a height adjustment for the cleaning module 73 can be made to allow a positioning of the cleaning module 73 immediately opposite to the print heads 22, 23, 24.

The drying module 57 comprises by way of example a strip-shaped arrangement of light sources not shown in detail, in particular light-emitting diodes, which are designed to provide ultraviolet radiation, the light sources being extended parallel to an rotation axis of the respective work piece carrier 4. Thus, the light beams provided by the light sources can illuminate the entire outer surface of the work piece during rotation of the work piece about the rotation axis and thus, for example, achieve a curing of ink that has been applied with the printing unit to the work piece 6. It is preferably provided that the respective drying module 57 can be arranged in vertical direction below the respective work piece carrier 4 for carrying out the drying or curing process. It is provided that the respective drying module 57 assumes the position shown in FIG. 3 relative to the work piece carrier 4.

By way of example, it is provided that the drying module 57 forms an assembly group with the cleaning module 73, which can be brought from the drying position shown in FIG. 3 into a cleaning position by aid of the actuator 74. For this purpose, it is provided that the work piece rotary table carries out a movement with the step width W/2, so that the work piece carriers 4 are not arranged opposite to the print heads 22, 23, 24. Subsequently, the cleaning module can be arranged by a combined horizontal and vertical movement of the actuator 74 immediately opposite to the print head module and a cleaning process for the print heads 22, 23, 24 may be started. For this purpose, the cleaning module 73 is equipped with an absorption material, not shown, which can receive a large amount of color, in particular ink, which is output from the print heads 22, 23, 24 during the execution of a cleaning cycle. During this cleaning cycle, preferably all the nozzles of the print heads 22, 23, 24 are driven for the delivery of ink and thereby optionally re-established.

What is claimed is:

1. A rotary table digital printing machine for printing on work pieces in an inkjet digital printing method, comprising a machine frame on which a work piece rotary table is rotatably mounted about a rotation axis, the work piece rotary table is provided with a plurality of work piece carriers, which are all arranged with the same angular pitch and the same distance from the rotation axis, wherein a drive unit is assigned to the work piece rotary table for providing a rotary step movement, wherein said machine frame comprises at least one holding frame designed for receiving workstations, which workstations are adapted for processing of work pieces, wherein at least one workstation is attached to the holding frame and is designed as a printing unit for printing on work pieces, wherein the printing unit comprises the following components arranged in series along an extension axis parallel to the rotation axis of the work piece rotary table:

a support frame supporting an inking unit;

a printing unit interface attached to the support frame;

a printing unit receptacle coupled to the printing unit interface;

a print head interface attached to the support frame opposite the printing unit interface; and a print head module attached to the print head interface for receiving ink from the ink unit of the support frame, the print head module being adapted for dispensing ink droplets in a printing direction onto a work piece and comprising:

a print head carrier;

at least one print head fixed to the print head carrier; and a carrier interface coupled to the print head interface, wherein the printing unit receptacle, the printing unit interface, the inking unit, the print head interface, the carrier interface and the print head module arranged along the extension axis are also arranged in a row arrangement extending along the printing direction.

2. The rotary table digital printing machine according to claim 1, wherein the carrier interface of the print head module and the print head interface each comprise a pair of centering elements, the pair of centering element of the carrier interface engaging with the pair of centering elements of the print head interface to facilitate reproducible positioning of the print head carrier relative to the support frame.

3. The rotary table digital printing machine according to claim 2, wherein the at least one print head is arranged in a predeterminable arrangement with respect to the at least two centering elements formed on the carrier interface.

4. The rotary table digital printing machine according to claim 2, wherein the carrier interface and/or the print head interface comprise a planar surface oriented normal to the printing direction, wherein at least two centering elements are arranged on the planar surface.

5. The rotary table digital printing machine according to claim 1, wherein the print head interface is movably mounted on the support frame with at least one degree of freedom of movement and in that an adjusting component for a provision of an adjusting movement between the support frame and print head interface is provided.

6. The rotary table digital printing machine according to claim 1, wherein the inking unit comprises a control unit, a color pipe for an ink supply and a discharge pipe for an ink discharge to the print head module, wherein the color pipe and the discharge pipe are connected to a valve unit, which is designed to influence an ink volume flow in the discharge pipe, and wherein the control unit is designed to control the valve unit and/or the at least one print head.

7. The rotary table digital printing machine according to claim 6, wherein the print head module at least two print heads, each print head having a plurality of printing nozzles which are arranged along a radial direction with constant pitch and forming a row of nozzles, the nozzle rows of the respective print heads are arranged parallel to each other and wherein at least one of the print heads comprises a positioning component which is designed for a linear displacement of the respective print head in the radial direction relative to the print head carrier, wherein the control unit is designed for a control of the print heads and the positioning component.

8. The rotary table digital printing machine according to claim 1, wherein at least one positioning unit for influencing a spatial orientation of the printing unit interface with respect to the holding frame is arranged between a printing unit receptacle attached on the holding frame and the holding frame.

9. The rotary table digital printing machine according to claim 1, wherein a color processing module arranged adjacent to the printing unit interface is arranged on an end region of the row arrangement which end region is opposite the print head module and that the color processing module is connected to a color pipe, which is designed for supplying ink to the inking unit.

10. The rotary table digital printing machine according to claim 9, wherein the color processing module comprises a pump unit for conveying printing ink and/or comprises an ink reservoir for temporary storage of printing ink and/or comprises a temperature control unit for a temperature control of the printing ink and/or comprises a degassing unit for degassing the printing ink and/or comprising a filter unit for filtering the printing ink.

11. The rotary table digital printing machine according to claim 1, wherein opposite to the print head module a drying module is arranged in the row arrangement and is arranged on the machine frame, which delimits a work piece gap with the print head module in the printing direction and which is designed for providing drying energy to a work piece arranged in the work piece gap.

12. The rotary table digital printing machine according to claim 1, wherein the work piece carriers determine a work piece plane oriented normal to the rotation axis of the work piece rotary table and that the printing unit interface, the inking unit, the print head interface, the carrier interface and the print head module are arranged in the vertical direction above the work piece plane.

13. A rotary table digital printing machine for printing on work pieces in an inkjet digital printing method, comprising a machine frame on which a work piece rotary table is rotatably mounted about a rotation axis, the work piece rotary table is provided with a plurality of work piece carriers, which are all arranged with the same angular pitch and the same distance from the rotation axis, wherein a drive unit is assigned to the work piece rotary table for providing a rotary step movement, wherein said machine frame comprises at least one holding frame designed for receiving workstations, which workstations are adapted for processing of work pieces, wherein at least one workstation is attached to the holding frame and is designed as a printing unit for printing on work pieces, wherein the printing unit comprises a support frame which is designed to receive an inking unit and a print head module and which has a printing unit interface which is designed for coupling with a printing unit receptacle associated with the holding frame, wherein the support frame comprises a print head interface which is adapted for coupling to a print head module, further comprising a print head module which is adapted for dispensing ink droplets in a printing direction onto a work piece and comprising a print head carrier and at least one print head fixed to the print head carrier, and further comprising an inking unit which is configured to provide ink to the print head module, the print head carrier comprising a carrier interface adapted for coupling to the print head interface, wherein the printing unit receptacle, the printing unit interface, the inking unit, the print head interface, the carrier interface and the print head module are arranged in a row arrangement extending along the printing direction, and wherein the work piece carriers determine a work piece plane oriented normal to the rotation axis of the work piece rotary table and that the printing unit interface, the inking unit, the print head interface, the carrier interface and the print head module are arranged in the vertical direction above the work piece plane, and wherein at least one color reservoir and a cleaning module are arranged in an area arranged in the vertical direction below the work piece plane.

14. The rotary table digital printing machine according to claim 1, wherein the printing direction is aligned parallel to the rotation axis.

15. The rotary table digital printing machine according to claim 5, wherein the print head interface is movably mounted on the support frame with at least one, in particular with exactly one, degree of freedom of movement and in that an adjusting component for a provision of a, in particular linear, adjusting movement between the support frame and print head interface is provided.

16. The rotary table digital printing machine according to claim 13, wherein the least one color reservoir and the cleaning module are combined with a drying module.

17. The rotary table digital printing machine according to claim 14, wherein the rotation axis is vertically oriented.

18. A printing unit for use in a rotary table digital printing machine, comprising;

a support frame supporting an inking unit, the inking unit comprising a color pipe for an ink supply, a discharge pipe for an ink discharge, and a valve unit connected to the color pipe and the discharge pipe for influencing an ink volume flow in the discharge pipe;

a printing unit interface attached to the support frame;

a printing unit receptacle coupled to the printing unit interface;

a print head interface attached to the support frame opposite the printing unit interface;

a print head module attached to the print head interface, the print head module being adapted for dispensing ink droplets in a printing direction onto a printing object and comprising a print head carrier, at least one print head fixed to the print head carrier, and a carrier interface coupled to the print head interface, wherein the printing unit interface, the inking unit, the print head interface, the carrier interface and the print head module are arranged in series along an extension axis extending parallel with the printing direction.

* * * * *